United States Patent [19]
Bentele et al.
[11] 4,443,158
[45] Apr. 17, 1984

[54] LIQUID RING PUMP WITH A CONTROL DISK ARRANGED BETWEEN THE IMPELLER HOUSING AND THE COVER

[75] Inventors: Benedikt Bentele, Hohenroth; Norbert Schmid; Siegfried Schönwald, both of Bad Neustadt, all of Fed. Rep. of Germany

[73] Assignee: Siemens Aktiengesellschaft, Munich, Fed. Rep. of Germany

[21] Appl. No.: 356,294

[22] Filed: Mar. 10, 1982

[30] Foreign Application Priority Data

Mar. 24, 1981 [DE] Fed. Rep. of Germany ..... 3111538

[51] Int. Cl.[3] ..... F04C 19/00

[52] U.S. Cl. ..... 417/68; 277/183; 277/212 C

[58] Field of Search ..... 417/68, 69; 277/12, 277/32, 212 R, 212 C, 166, 183, 186

[56] References Cited

U.S. PATENT DOCUMENTS 2,197,288 4/1940 Baker ..... 417/68

3,367,682 2/1968 Meriano ..... 277/212 X

*Primary Examiner*—Edward K. Look
*Attorney, Agent, or Firm*—Kenyon & Kenyon

[57] ABSTRACT

A liquid ring pump having a control disk interposed between the impeller housing and a cover provided with connecting stubs is disclosed. A seal is interposed between the cover and the control disk and pressed against the control disk by a supporting edge of the cover. The seal further has a central web separating the pressure and the suction spaces formed in the cover. The interior of the impeller housing is sealed from the exterior thereof at the edge resting against the control disk. Sealing at two spaced locations, i.e. at the edge of the housing and between the cover and the control disk, is accomplished with a one-piece seal in accordance with the invention by providing a cup-shaped seal which has at the free end of its circumferential wall a radially outward-extending bead which is pressed against the rim of the impeller housing by an edge of the cover which axially extends beyond the circumferential wall.

5 Claims, 4 Drawing Figures

LIQUID RING PUMP WITH A CONTROL DISK ARRANGED BETWEEN THE IMPELLER HOUSING AND THE COVER

BACKGROUND OF THE INVENTION

The present invention relates to a liquid ring pump housing of the type having a control disk arranged between the impeller housing and the cover.

A Siemens Vacuum Pump Type 2BV1 is a liquid ring pump of the above type. In that pump, a disk-shaped gasket is inserted between the cover and the control disk. The impeller housing is sealed from the outside by inserting a sealing compound between the control disk and the edge of the impeller housing.

OBJECTS AND SUMMARY OF THE INVENTION

It is an object of the present invention to provide a liquid ring pump of the above type with an improved sealing arrangement.

It is another object of the present invention to provide a liquid ring pump of the above type in which the sealing arrangement between the cover and the control disk as well as between the interior and exterior of impeller housing is made by a one-piece gasket.

According to the invention, a cup-shaped seal or gasket is provided which has at the free end of its circumferential wall a radially outwardly-facing bead which is pressed against the edge of the impeller housing by a rim of the cover which extends axially beyond the circumferential wall. Sealing at two physically spaced locations, i.e. at the edge of the housing and between the cover and the control disk, can thereby be accomplished by a single seal.

Mutually engaging projections and depressions are provided in accordance with the invention on the side of the seal bottom facing the control disk and on the corresponding side of the control disk. This simplifies alignment of the control disk and the seal. In addition, the disk and seal are thereby held in alignment during further assembly operations. The proper position of the aligned disk and seal relative to the cover is ensured by also providing mutually engaging projections and depressions on the side of the seal bottom facing the cover and on the corresponding side of the cover.

In liquid ring pumps with passage openings which are controlled by valve reeds of a valve plate as a function of pressure, a simple assembly of the valve plate and the stop plate associated therewith is provided in accordance with the invention by disposing on the side of the seal bottom facing the control disk, positioning means which secures the stop plate and the valve plate in their desired positions. A rib on the cover presses the stop and valve plates against the control disk.

According to an aspect of the invention, separate fabrication and assembly of the valve stop plates is eliminated by forming the valve reeds in the bottom of the cup-shaped seal and providing a stop member at the cover opposite the valve reeds.

The above and other objects, features, aspects and advantages of the invention will be more apparent from the following description of the preferred embodiments of the invention taken in conjunction with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Figure 1:
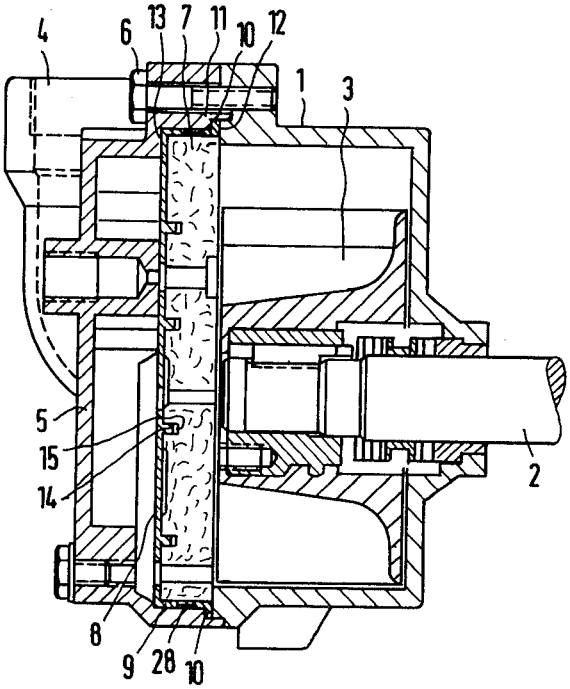
FIG. 1 is a cross-sectional view of a liquid ring pump according to the invention.

Referring to FIG. 1, an impeller 3 is disposed on a drive shaft 2 rotatably disposed in an impeller housing 1. The drive shaft 2 is arranged eccentrically relative to the central axis of the impeller housing 1. A cover 5 provided with connecting stubs 4 is mounted on the impeller housing 1 and connected thereto by screws 6. A control disc 7 is interposed between the cover 5 and the impeller housing 1. The control disk 7 is in turn inserted into a cup-shaped seal or gasket 8. At the free end of the circumferential wall 9 of the cup-shaped seal 8 is provided a radially outwardly-extending bead 10 which is pressed against the rim 12 of the impeller housing by an edge 11 of the cover 5 which extends axially beyond the circumferential wall 9 of the seal. The bead arrangement seals the interior of the impeller housing from the exterior thereof. The bottom of the cup-shaped seal 8 rests on a supporting edge 13 of the cover 5. The supporting edge 13 presses the bottom of the cup-shaped seal 8 against the control disk 7, thereby also forming a seal between the cover and the control disk.

On the side of the bottom of the cup-shaped seal 8 facing the control disk, projections 14 are provided which engage corresponding depressions 15 in the control disk 7. Thereby, the cup-shaped seal 8 and the control disk 7 are mutually positioned. Also, on the side of the cup-shaped seal facing the cover and on the corresponding side of the cover mutually engaging projections and depressions are also provided.

Figure 2:
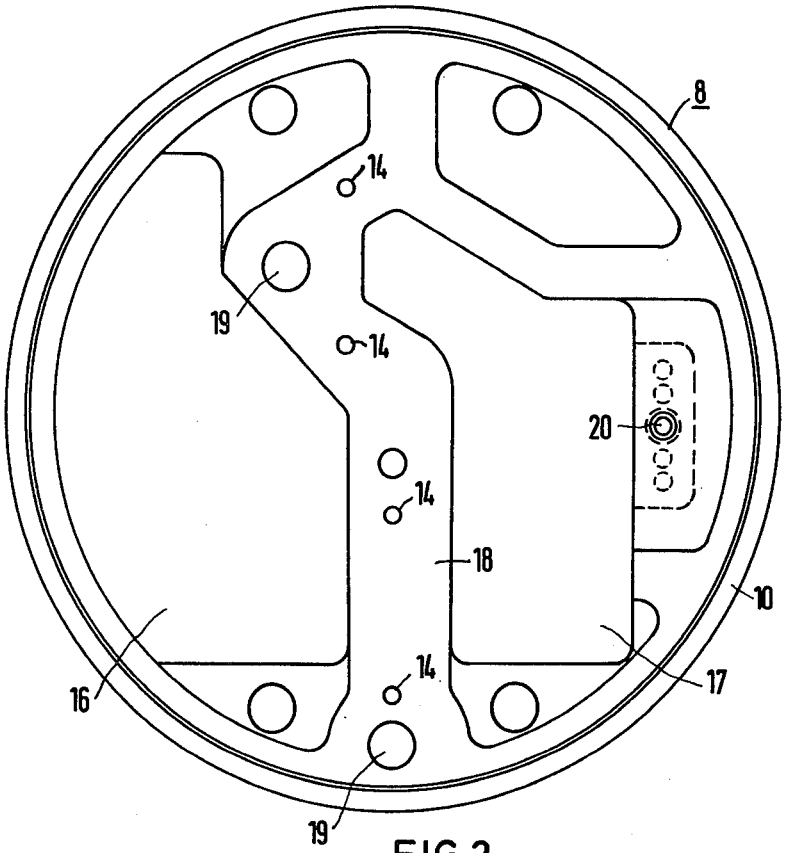
FIG. 2 is a top view of a cup-shaped seal of the liquid ring pump of FIG. 1.

Referring next to FIG. 2, a first cutout 16 and a second cutout 17 are provided in the bottom of the cup-shaped seal 8. The first cutout 16, in the area of the suction stub and the suction slot of the control disk, admits the medium to be pressurized. The second cutout 17 allows the pressurized medium to enter into the outlet stub from the pressure slot of the control disk. A central web 18 between the two cutouts separates the suction and pressure spaces provided in the cover bottom. The projections 14 are formed on the central web 18. Further openings 19 for admitting and discharging the working liquid are provided in the web 18 and coincide with corresponding openings in the control disk 7 and in the cover 5.

Figure 4:
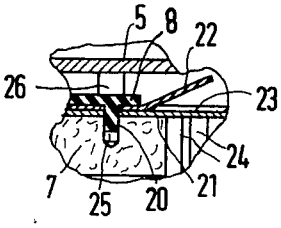
FIG. 4 is a detail in cross section of a valve plate and stop plate arrangement according to the invention in the liquid ring pump of FIG. 1 shifted 90° from the section view of FIG. 1.

As depicted in FIG. 4, a post 20 is disposed on the bottom side of the cup-shaped seal 8 facing the control disk 7 which engages a corresponding opening in a valve plate 21 and a stop plate 22. The valve plate 21 includes valve reeds 23 which cover passages 24 provided in the control disk 7. The stop plate 22 limits the lifting motion of the valve reeds 23. The valve plate 21 and the stop plate 22 are secured in the positions described above by the post 20 which engages a corresponding hole 25 in the control disk 7, as well as by flanges or projections of the stop plate which engage cutouts in the valve plate and the control disk. A rib 26 formed at the cover 5 presses the seal against the stop plate 22 and the valve plate 21. The valve and stop plates are thereby held in their assembled position without the need for additional fastening parts.

Figure 3:
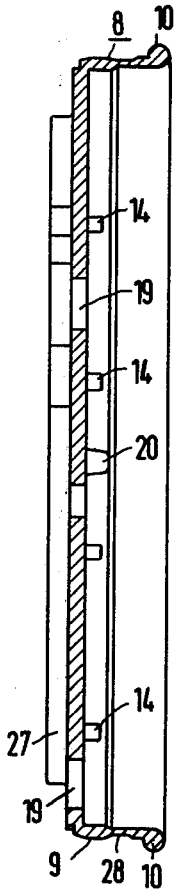
FIG. 3 is a cross-sectional view of the cup-shaped seal of FIG. 2.

Referring now to FIG. 3, the cup-shaped seal 8 has at its bottom side facing the cover a support rib 27 which rests against a correspondingly shaped separation rib of the cover 5 disposed between the pressure and the suction spaces, and thus prevents the central web 18 from being shifted towards the suction space. At the circumferential wall 9 of the seal 8, the wall thickness is reduced in a region 28. This reduced wall thickness enables the circumferential wall 9 to be stretched more easily in the axial direction thereby equalizing length tolerances to facilitate assembly of the pump. In addition, the thickness of the bottom of the cup-shaped seal 8 can be chosen, according to the elasticity of the material of the seal, so that manufacturing tolerances of the individual parts to be assembled can be compensated. Since the control disk 7 is largely enclosed by the cup-shaped seal 8, the disk is protected from mechanical damage during assembly and disassembly thereof.

The advantages of the present invention, as well as certain changes and modifications of the disclosed embodiments thereof, will be readily apparent to those skilled in the art. It is the applicants' intention to cover by their claims all those changes and modifications which could be made to the embodiments of the invention herein chosen for the purpose of disclosure without departing from the spirit and scope of the invention.

What is claimed is:

1. In a liquid ring pump comprising an impeller housing, a cover, a control disk interposed between the cover and the housing, and sealing means interposed between the cover and the control disk for sealing the cover and the disk and for sealing the interior of the impeller housing from the exterior thereof at the edge of the cover adjacent to the control disk, the improvement comprising a single cup-shaped seal interposed between the cover and the control disk for sealing the cover and the control disk and having at the free end of its circumferential wall a bead which extends radially outwardly, and the cover having a rim which extends beyond the circumferential wall, the seal being disposed to be pressed against the edge of the impeller housing by the rim of the cover.

2. In the liquid ring pump and the improvement therein according to claim 1, the improvement further comprising mutually engaging projections and depressions provided on the side of the seal bottom facing the control disk and on the corresponding side of the control disk.

3. In the liquid ring pump and the improvement therein according to claim 1, the improvement further comprising mutually engaging the projections and depressions provided on the side of the seal bottom facing the cover and on the corresponding side of the cover.

4. In the liquid ring pump and the improvement therein according to claim 1, 2 or 3, in which the control disk of the liquid ring pump is provided with passages to the pressure slot of the liquid ring pump which can be held in an open position as a function of pressure by valve reeds of a valve plate, the lifting motion of which is limited by a stop plate, the valve plate and the stop plate being held in mutual positions by mutually engaging elements in a formlocking manner, the improvement further comprising positioning means disposed on the side of the seal bottom facing the control disk for securing the stop plate and the valve plate in their mutual positions, and a rib disposed on the cover passing the stop and the valve plates against the control disk.

5. In the liquid ring pump and improvement therein according to claim 3, in which the control disk of the liquid pressure pump further has passages which can be held open by means of valve reeds of a valve plate which are limited in their lifting motion by a stop, the improvement further comprising the valve reeds being formed in the bottom of the cup-shaped seal and the stop being disposed on the cover opposite the valve reeds.

* * * * *